US007222711B2

(12) United States Patent
Chang

(10) Patent No.: US 7,222,711 B2
(45) Date of Patent: May 29, 2007

(54) MULTIPLE COIN ACTUATION MECHANISM

(76) Inventor: Kil Jae Chang, T. PiCO. Korea Manufacturing, 321-37 Suksu, 2 Dong, Anyang City, Kyungdido (KR)

( * ) Notice: Subject to any disclaimer, the term of this patent is extended or adjusted under 35 U.S.C. 154(b) by 528 days.

(21) Appl. No.: 10/798,189

(22) Filed: Mar. 11, 2004

(65) Prior Publication Data

US 2004/0206602 A1 Oct. 21, 2004

Related U.S. Application Data

(60) Provisional application No. 60/463,305, filed on Apr. 16, 2003.

(51) Int. Cl.

| | |
|---|---|
| ***G07D 3/00*** | (2006.01) |
| ***G07F 11/00*** | (2006.01) |
| ***G07F 5/00*** | (2006.01) |
| ***G07F 13/00*** | (2006.01) |
| ***G07F 15/00*** | (2006.01) |
| ***G07F 17/00*** | (2006.01) |

(52) U.S. Cl. ..... 194/254; 194/232; 194/235; 194/236; 194/335; 194/338

(58) Field of Classification Search ..... 194/229, 194/232–237, 253, 254, 292, 334, 335, 338
See application file for complete search history.

(56) References Cited

U.S. PATENT DOCUMENTS

| | | | | |
|---|---|---|---|---|
| 4,350,239 A * | 9/1982 | Tsuiki | ..... | 194/295 |
| 5,259,532 A * | 11/1993 | Schwarzli | ..... | 221/304 |
| 5,657,848 A | 8/1997 | Schwarzli | ..... | 194/236 |
| 5,924,542 A | 7/1999 | Schwarzli | ..... | 194/236 |

* cited by examiner

*Primary Examiner*—Patrick Mackey
*Assistant Examiner*—Jeffrey A. Shapiro
(74) *Attorney, Agent, or Firm*—John R. Flanagan

(57) ABSTRACT

A multiple coin actuation mechanism has a carrier wheel with angularly spaced first and second coin recesses aligned with first and second coin slots of a front cover plate when the carrier wheel is in an initial home position at which a user initially deposits first and second coins into the first and second coin recesses through the first and second coin slots. A pivotal coin removal blocking latch and an edge notch defined adjacent to one side of the first coin recess in the carrier wheel allows initial insertion of the first coin through the first coin slot into the first coin recess while preventing removal of the second coin from the second coin recess through the first coin slot when the carrier wheel has turned sufficiently to align the second coin recess with the first coin slot.

7 Claims, 4 Drawing Sheets

MULTIPLE COIN ACTUATION MECHANISM

This patent application claims the benefit of U.S. provisional application No. 60/463,305, filed Apr. 16, 2003.

TECHNICAL FIELD

The present invention generally relates to coin operated vending machines and, more particularly, is concerned with a multiple coin actuation mechanism for a vending machine.

BACKGROUND ART

U.S. Pat. Nos. 5,657,848 and 5,924,542 to Schwarzli discloses a prior art two-coin actuation mechanism for a vending machine. The two-coin actuation mechanism has a front cover plate with first and second coin slots, a rotatable carrier wheel with first and second coin recesses angularly spaced apart on one face of the carrier wheel and aligned with the first and second coin slots of the cover plate when the carrier wheel is in a home position for the user to deposit a coin into each of the coin recesses, and a notched wheel connected with an opposite face of the carrier wheel for rotation therewith and defining a lobe with notches on front and rear portions of the lobe.

The two-coin mechanism also has a rear retainer plate overlying the carrier wheel and notched wheel and fixedly attached to the front cover plate, and first and second spring-biased detents movably mounted to the rear retainer plate. The detents engage the notched wheel and cooperate with the notches of the notched wheel to prevent rotation of the notched wheel and thus rotation of the carrier wheel unless coins have been deposited into the first and second coin recesses of the carrier wheel.

The two-coin actuation mechanism further has a handle disposed adjacent to and exterior of the front cover plate with a shaft which extends through the front cover plate, carrier wheel, notched wheel and rear retainer plate to rearwardly thereof where a ratchet wheel and gear are fixedly mounted to the rear end of the shaft. The handle may be turned by a user to rotate the shaft and the carrier wheel, ratchet wheel and gear therewith such that when coins have been deposited into the first and second coin recesses on the carrier wheel the detents ride over the deposited coins and do not engage in the coin recesses and such rotation of the carrier wheel causes the deposited coins to exit the carrier wheel at a discharge location into a coin collection box and such rotation of the gear to actuate a dispensing mechanism to cause an item to be dispensed from the machine to the user. Also, spring-loaded pawl is pivotally mounted to the rear retainer plate adjacent to the ratchet wheel so as to engage the ratchet wheel such that the ratchet wheel and the gear, shaft and handle therewith can only be turned in one direction.

The two-coin actuation mechanism still further includes a rocker bar fixedly mounted on the rear retainer plate and having an end stop which normally extends through a hole in the rear retainer plate to adjacent to a slot on the cover plate but not extend from the slot so as to intersect with the path of any coin moved into or removed from the first coin slot of the front cover plate which would block movement or removal of the coin. With reference to the direction of rotation of the handle, shaft and carrier wheel, the second coin slot is the one farther from the coin discharge location than the first coin slot so that when a coin is deposited through the second coin slot and into the second coin recess it is carried by the carrier wheel past the first coin slot on its way to the discharge location. However, upon turning the handle and thus the shaft, carrier wheel and ratchet wheel therewith and as the second coin recess and the coin deposited therein are brought into alignment with the first coin slot, a cam element on the ratchet wheel engages the rocker bar and causes it to deflect so as to project its end stop through the slot on the cover plate and across the coin path thereby blocking removal of the coin from the second coin recess of the carrier wheel through the first coin slot of the front cover plate. This action of the rocker bar and its end stop is synchronized by the cam element to only occur when the coin in the second coin recess is aligned with the first coin slot. At all other times the rocker bar is undeflected and thus its end stop is withdrawn from extension through the slot.

Problems exist, however, with the design of this prior art two-coin actuation mechanism. First, the first and second coin recesses in the coin carrier wheel of this two-coin mechanism are each designed to receive only a single coin. Second, the coin carrier wheel of this two-coin mechanism, by having the coin recesses on one face and a notched wheel on the opposite face with the detent-engaging notches and further by using the rocker bar coin blocking device, has proportionately increased the complexity and cost of the design over that of the conventional prior art single-coin actuation mechanism.

Consequently, there is a continuing need for further innovations that will overcome these drawbacks.

DISCLOSURE OF INVENTION

The present invention provides a multiple coin actuation mechanism designed to satisfy the aforementioned need. The multiple coin actuation mechanism of the present invention retains the structural features of a conventional prior art single-coin actuation mechanism while introducing a minimum of additions or modifications thereto in order to provide the multiple coin capability in the actuation mechanism of the present invention. Specifically, the multiple coin actuation mechanism employs a rotatable carrier wheel as in the prior art single-coin actuation mechanism but now with first and second coin recesses at positions angularly spaced apart from one another which are aligned with first and second coin slots of a front cover plate when the carrier wheel is in an initial home position at which a user initially deposits first and second coins into the first and second coin recesses through the first and second coin slots. Also, the multiple coin actuation mechanism employs a pivotal coin removal blocking latch and provides an edge notch defined adjacent to one side of the first coin recess in the carrier wheel which allows initial insertion of the first coin through the first coin slot into the first coin recess while preventing removal of the second coin from the second coin recess through the first coin slot when the carrier wheel is turned sufficiently to align the second coin recess with the first coin slot. Also, in the multiple coin actuation mechanism one multiple coin carrier wheel can be replaced with another one which is identical except for a change in the width of one or both of the coin recesses in order to accommodate a different number of coins in the coin recesses.

Accordingly, the present invention is directed to a multiple coin actuation mechanism for a vending machine which comprises: (a) a front cover plate adapted to be fixedly attached to a vending machine, the front cover plate having a periphery and first and second coin slots defined in the periphery at locations angularly spaced apart from one another; (b) a carrier wheel mounted for rotation relative to the front cover plate and having a front side facing toward the front cover plate and a rear side facing away from the front cover plate, the carrier wheel also having first and second coin recesses defined on the rear side of the carrier wheel at positions angularly spaced apart from one another and aligned with the first and second coin slots of the cover plate when the carrier wheel is in an initial home position at which a user can initially deposit first and second coins into the first and second coin recesses through the first and second coin slots; (c) a rear retainer plate fixedly attached to the front cover plate and at least partially overlying the carrier wheel at the rear side thereof; (d) first and second detents movably mounted to the rear retainer plate so as to engage the carrier wheel within the first and second coin recesses on the rear side of the carrier wheel and cooperate with the first and second coin recesses to prevent rotation of the carrier wheel away from the initial home position through a complete dispensing cycle unless first and second coins have been deposited into the first and second coin recesses; and (e) means for allowing insertion of the first coin through the first coin slot of the front cover plate and into the first coin recess of the carrier plate and also for preventing removal of the second coin from the second coin recess of the carrier wheel through the first coin slot of the front cover plate when the carrier wheel has been rotated sufficiently to align the second coin recess of the carrier wheel with the first coin slot of the front cover plate as the carrier wheel is rotated from the initial home position to a final dispensing position through the complete dispensing cycle such that during the rotation the detents will ride over the deposited first and second coins and not engage within the first and coin recesses of the carrier wheel such that the rotation of the carrier wheel will result in the deposited first and second coins successively exiting from the carrier wheel at the discharge location.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

BEST MODE FOR CARRYING OUT THE INVENTION

Figure 2:
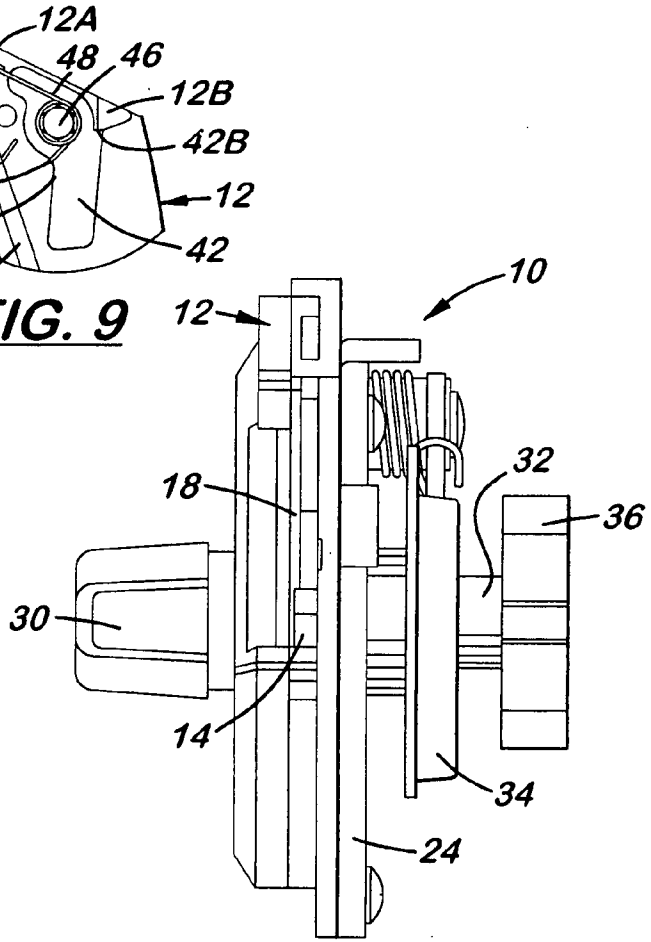
FIG. 2 is a right side elevational view of the actuation mechanism of FIG. 1.

Referring to the drawings, and particularly to FIGS. 1-4, there is illustrated a multiple coin actuation mechanism, generally designated 10, of the present invention. As mentioned before, the multiple coin actuation mechanism 10 retains the structural features of a conventional prior art single-coin actuation mechanism and introduces a minimum of additions or modifications thereto in order to provide the multiple coin actuation mechanism 10 of the present invention.

Figure 4:
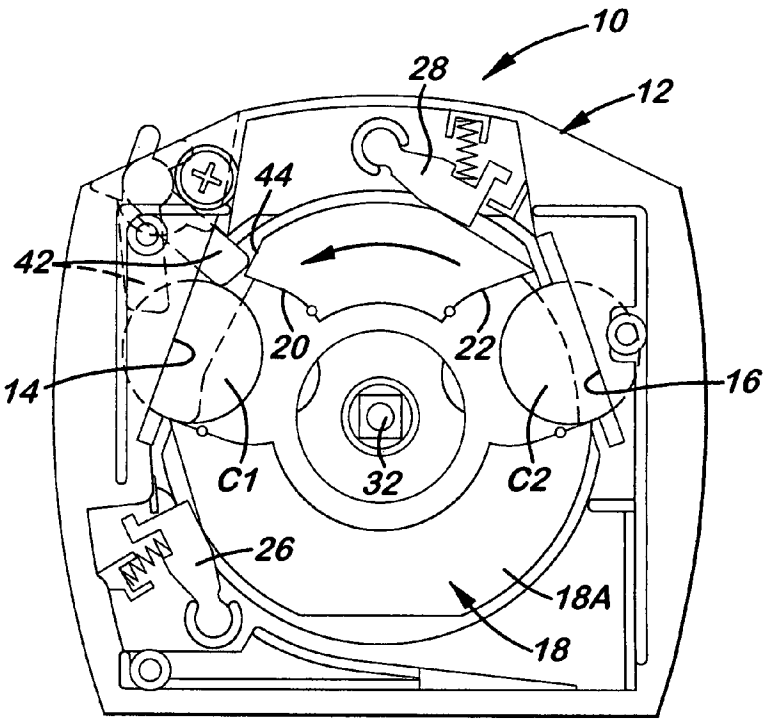
FIG. 4 is a rear elevational view of the actuation mechanism similar to that of FIG. 3 except with the rear retainer plate and one-way ratchet device removed to expose the rear side of a carrier wheel and now showing depositing of first and second coins through first and second coil slots in a front cover plate and into first and second coin recesses in the carrier wheel.
Figure 3:
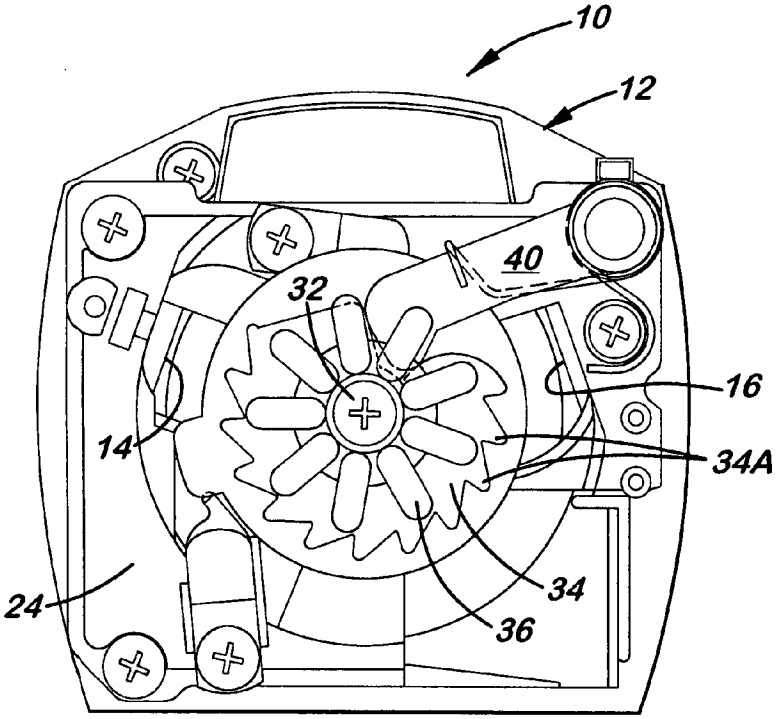
FIG. 3 is a rear elevational view of the actuation mechanism of FIG. 1.
Figure 6:
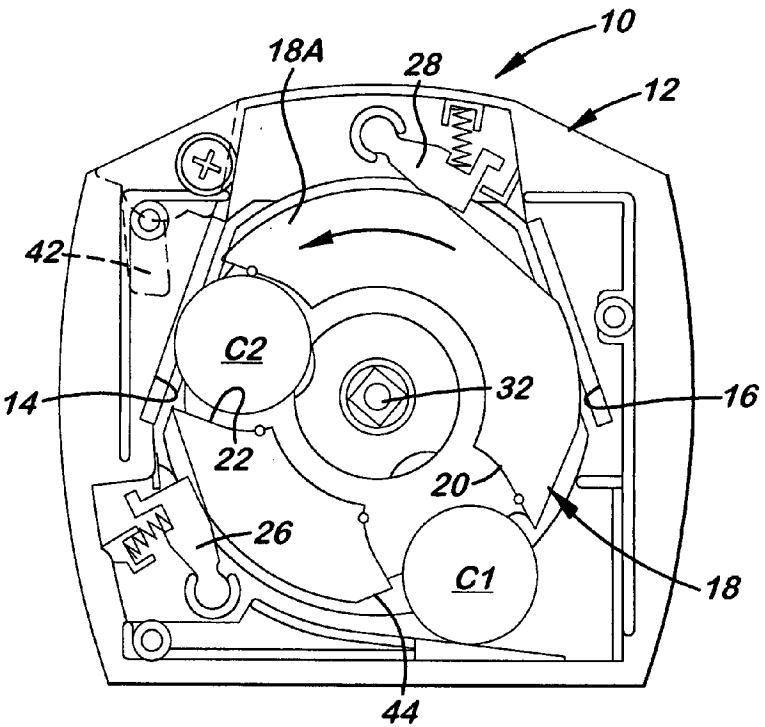
FIG. 6 is a rear elevational view similar to that of FIG. 5 but now showing the carrier wheel rotating in a counterclockwise direction such that the first coin has reached a discharge location as the second coin is passing the location of the first coin slot.
Figure 5:
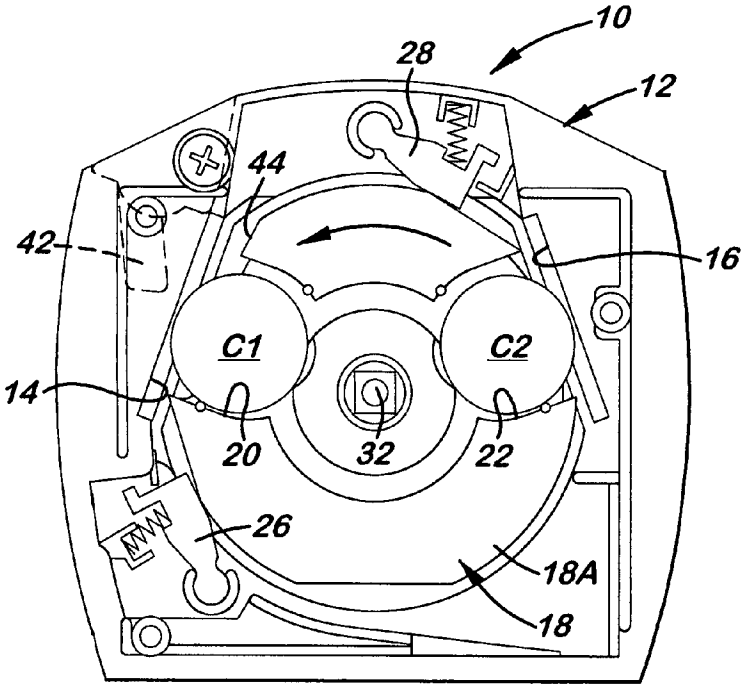
FIG. 5 is a rear elevational view similar to that of FIG. 4 but now showing the first and second coins resting in the first and second coin recesses of the carrier wheel.

The multiple-coin actuation mechanism 10 basically includes a front cover plate 12 with first and second coin slots 14, 16 angularly spaced apart from one another about the periphery of the front cover plate 12, and a rotatable carrier wheel 18 with first and second coin recesses 20, 22 angularly spaced apart from one another and defined on a rear face or side 18A of the carrier wheel 18 and aligned with the first and second coin slots 14, 16 of the cover plate 12 when the carrier wheel 18 is in an initial home position for the user to deposit first and second coins C1, C2 into the respective coin recesses 20, 22, as seen in FIG. 4. In contrast thereto, the conventional single-coin actuation mechanism has a front cover plate with a single coin slot, and a rotatable carrier wheel with a single coin recess and aligned with the single coin slot of the cover plate when the carrier wheel is in the home position.

The multiple-coin actuation mechanism 10 also has a rear retainer plate 24 at least partially overlying the carrier wheel 18 and fixedly attached to the front cover plate 12, first and second spring-biased detents 26, 28 movably mounted to the retainer plate 24 so as to engage the carrier wheel 18 in the first and second coin recesses 20, 22 and cooperate with the recesses 20, 22 of the carrier wheel 18 to prevent rotation of the carrier wheel 18 unless coins C have been deposited into the first and second coin recesses 20, 22 of the carrier wheel 18. In contrast thereto, the single-coin actuation mechanism has a rear retainer plate overlying the carrier wheel and fixedly attached to the front cover plate and a single spring-biased detent movably mounted to the retainer plate so as to engage the carrier wheel in the single coin recess and cooperate with the recess of the carrier wheel to prevent rotation of the carrier wheel unless the coin has been deposited into the single coin recess of the carrier wheel.

The multiple coin actuation mechanism 10 further has a handle 30 disposed adjacent to and exterior of the front cover plate 12 with an elongate shaft 32 which extends through the front cover plate 12, carrier wheel 18 and rear retainer plate 24 to rearwardly thereof. Also, the actuation mechanism 10, same as the conventional one-coin actuation mechanism, has a one-way ratchet device which includes a ratchet wheel 34 and gear 36 fixedly mounted to the rear end of the shaft 32. The handle 30 may be turned by a user to rotate the shaft 32 and the carrier wheel 18, ratchet wheel 34 and gear 36 therewith such that when first and second coins C1, C2 have been deposited into the first and second coin recesses 20, 22 on the carrier wheel 18 the detents 26, 28 ride over the deposited coins C1, C2 and do not engage in the coin recesses 20, 22. Such rotation of the carrier wheel 18 causes the deposited coins C1, C2 to exit the carrier wheel 18 at a discharge location 38 into a coin collection box (not shown) and such rotation of the gear 36 actuates a dispensing mechanism (not shown) to cause an item to be dispensed from the machine to the user. In the conventional single-coin actuation mechanism, the same operation and action happens except that only a single detent rides over the deposited coin and does not engage in the single coin recess. Also, same as in the conventional single-coin actuation mechanism, the one-way ratchet device of the multiple-coin actuation mechanism 10 further has a spring-loaded pawl 40 pivotally mounted to the rear retainer plate 24 adjacent to the ratchet wheel 34 so as to engage the ratchet wheel 34 such that the ratchet wheel 34 and the gear 36, shaft 32 and handle 30 therewith can only be turned in one direction once the pawl 40 has engaged one of the notches 34A in the row thereof defined on the ratchet wheel 34.

Figure 9:
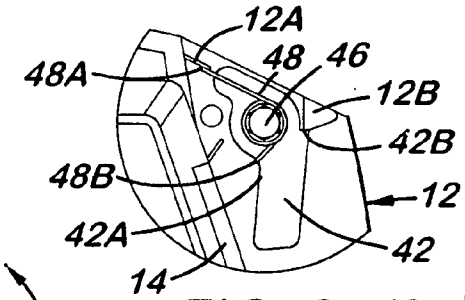
FIG. 9 is an enlarged detailed view of the portion of the actuation mechanism enclosed by circle 9 in FIG. 1.
Figure 1:
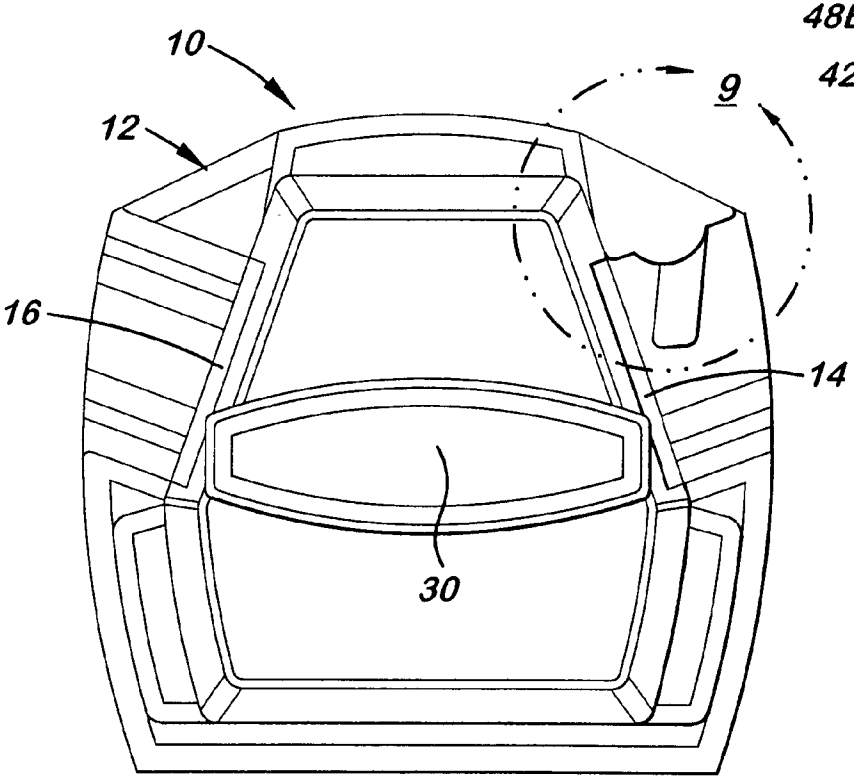
FIG. 1 is a front elevational view of a multiple coin actuation mechanism of the present invention.

Referring now also to FIGS. 5-8, for allowing the initial insertion of the first coin C1 through the first coin slot 14 into the first coin recess 20 and also for preventing removal of the second coin C2 from the second coin recess 16 through the first coin slot 14 when the carrier wheel 18 has been turned sufficiently to align the second coin recess 16 with the first coin slot 14, several unique features have been incorporated by the multiple coin actuation mechanism 10 which are not found in the single-coin actuation mechanism. These unique features in the multiple coin actuation mechanism 10 are a pivotal coin removal blocking latch 42, as seen in FIG. 9, and an edge notch 44 defined adjacent to one side of the first coin recess 20 in the carrier wheel 18, as seen in FIGS. 4-8. As seen in FIG. 9, the latch 42 is pivotally mounted about a stud 46 fixedly attached on and extending outwardly from the front cover plate 12, and a coil spring 48 is provided which has opposite ends 48A, 48B engaging respective adjacent portions 12A, 42A of the front cover plate 12 and the pivotal latch 42 so as to bias the pivotal latch 42 to the initial outer position, as seen in solid line form in FIG. 9 and in dashed line form in FIGS. 4-8. When the coin carrier wheel 18 is at its initial home position, as seen in FIG. 4, the insertion of the first coin C1 through the first coin slot 14 will engage and cause the latch 42 to pivotally move against the bias of the coil spring 48 toward the first coin recess 20. The presence of the edge notch 44 on one side of the first coin recess 20 allows the latch 42 to pivot to a first inner position in which the latch 42 does not block the path of movement of the first coin C1 through the first coin slot 14 and into the first coin recess 20. However, once the carrier wheel 18 has been rotated to the position shown in FIG. 6 which places the second coin C2 and second coin recess 22 in alignment with the first coin slot 14, it can be seen that the latch 42 can only pivot to a second inner position in which the latch 42 engages the second coin C2. Also in view that the latch 42 at its outer first position has a shoulder 42B, as seen in FIG. 11, that engages a stop ledge 12B on the front cover plate 12, the latch 42 is retained across the path of the second coin C2 from the second coin recess 22 through the first coin slot 14 so as to prevent the removal of the second coin C2 from the first coin slot 14.

Figure 10:
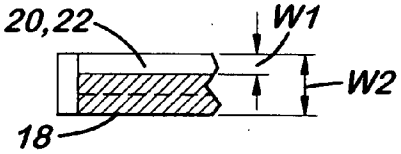
FIG. 10 is an enlarged fragmentary cross-sectional view of the carrier wheel taken along line 10-10 of FIG. 8.
Figure 8:
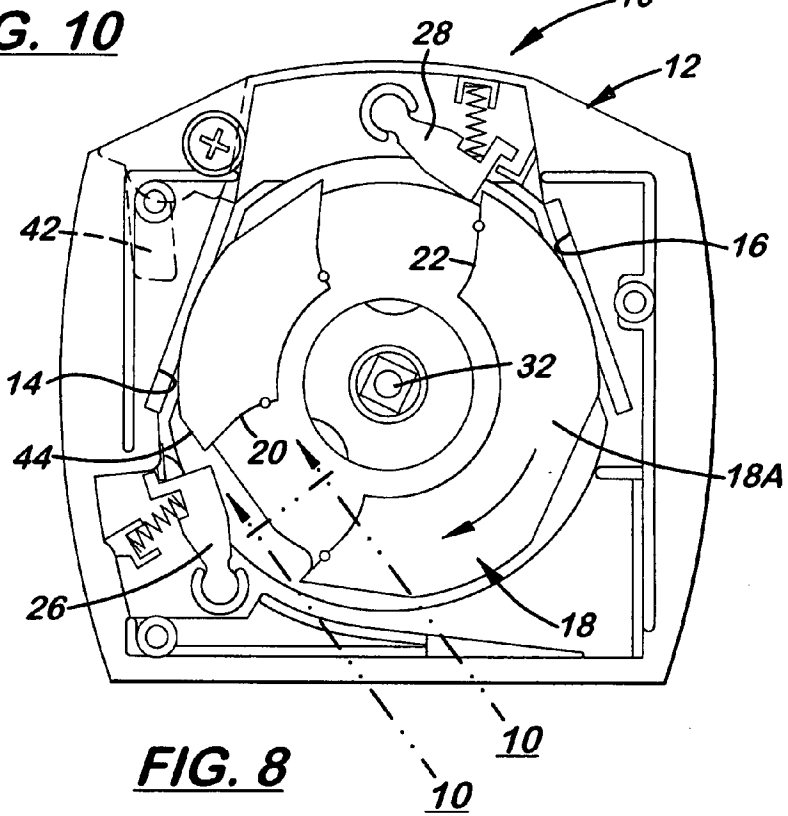
FIG. 8 is a rear elevational view of the actuation mechanism showing one of first and second detents engaged within the corresponding one of the first and second coin recesses on the carrier wheel to prevent rotation of the carrier wheel away from the initial home position through a complete dispensing cycle where the first and second coins have not been deposited into the first and second coin recesses.
Figure 7:
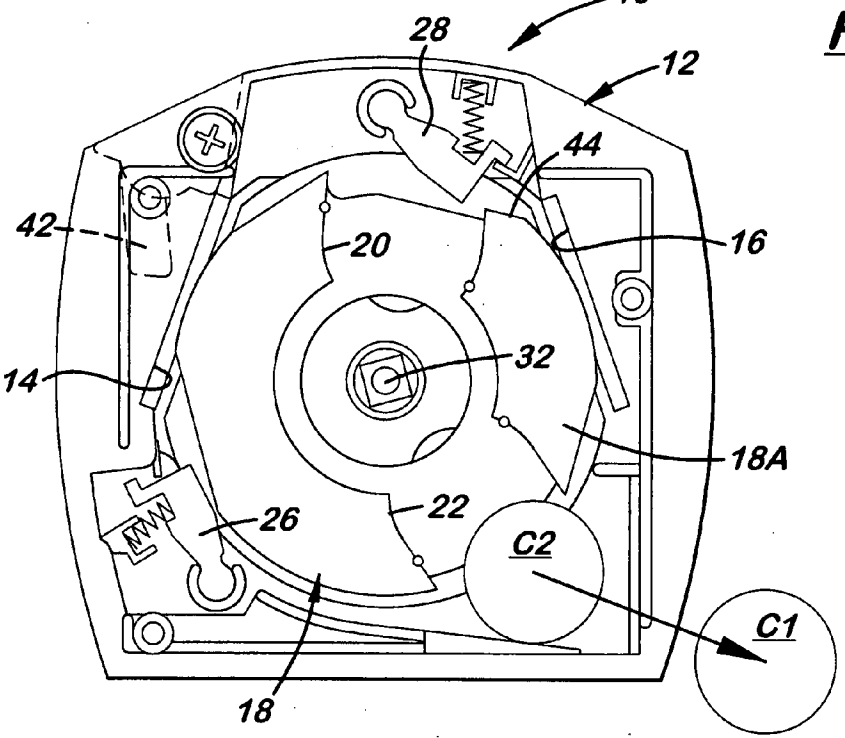
FIG. 7 is a rear elevational view similar to that of FIG. 6 but now showing the carrier wheel further rotating in the counterclockwise direction such that the second coin has reached the discharge location.

An additional unique feature incorporated by the multiple coin actuation mechanism 10 is that the multiple coin carrier wheel 18 can be replaced with another one which is identical except for a change in the width of one or both of the coin recesses 20, 22 in order to accommodate a total of three or four coins in the coin recesses 20, 22. In FIG. 10, there is shown a first width W1 of the coin recess 20, 22 which accommodates one coin and a second width W2 which accommodates two coins.

It is thought that the present invention and many of its advantages will be understood from the foregoing description and it will be apparent that various changes may be made thereto without departing from the spirit and scope of the invention or sacrificing all of its material advantages, the forms hereinbefore described being merely preferred or exemplary embodiments thereof.

The invention claimed is:

1. A multiple coin actuation mechanism for a vending machine, comprising:

(a) a front cover plate adapted to be fixedly attached to a vending machine, said front cover plate having a periphery and first and second coin slots defined in said periphery at locations angularly spaced apart from one another;

(b) a carrier wheel mounted for rotation relative to said front cover plate and having a front side facing toward said front cover plate and a rear side facing away from said front cover plate, said carrier wheel also having first and second coin recesses defined on said rear side of said carrier wheel at positions angularly spaced apart from one another and aligned with said first and second coin slots of said cover plate when said carrier wheel is in an initial home position at which a user can initially deposit first and second coins into said first and second coin recesses through said first and second coin slots;

(c) a rear retainer plate fixedly attached to said front cover plate and at least partially overlying said carrier wheel at said rear side thereof;

(d) means for engaging said carrier wheel within said first and second coin recesses on said rear side of said carrier wheel and cooperating with said first and second coin recesses to prevent rotation of said carrier wheel away from said initial home position through a complete dispensing cycle unless first and second coins have been deposited into said first and second coin recesses; and (e) means for allowing insertion of the first coin through said first coin slot of said front cover plate and into said first coin recess of said carrier plate and also for preventing removal of the second coin from said second coin recess of said carrier wheel through said first coin slot of said front cover plate when said carrier wheel has been rotated sufficiently to align said second coin recess of said carrier wheel with said first coin slot of said front cover plate as said carrier wheel is rotated from said initial home position to a final dispensing position through said complete dispensing cycle such that during said rotation of said carrier wheel said means for engaging said carrier wheel will not engage within said first and coin recesses of said carrier wheel such that said rotation of said carrier wheel will result in the deposited first and second coins successively exiting from said carrier wheel at said discharge location, wherein said means for allowing insertion of the first coin includes (i) a coin removal blocking latch pivotally mounted on said front cover plate adjacent to said first coin slot, and (ii) an edge notch defined adjacent to one side of said first coin recess in said carrier wheel such that said coin removal blocking latch can pivotally move from an initial outer position to a first inner position in which said latch is disposed into said edge notch of said first coin recess so as to allow initial insertion of the first coin Past said latch and through said first coin slot into said first coin recess whereas once said carrier wheel has rotated to a position which places the second coin and said second coin recess in alignment with the first coin slot said latch can only pivot to a second inner position in which said latch engages the second coin and thus prevents removal of the second coin from said second coin recess past said latch through said first coin slot, said latch also at said outer first position being retained across the oath of the second coin from said second coin recess through said first coin slot so as to prevent the removal of the second coin from said first coin slot.

2. The actuation mechanism of claim 1 wherein said means for allowing insertion of the first coin also includes a stud fixedly attached on and extending outwardly from said front cover plate adjacent to said first coin slot such that said pivotal latch is pivotally mounted about said stud.

3. The actuation mechanism of claim 2 wherein said means for allowing insertion of the first coin further includes a coil spring having opposite ends engaging respective adjacent portions of said front cover plate and said pivotal latch so as to bias said pivotal latch to an initial outer position such that when said carrier wheel is at said initial home position insertion of the first coin through said first coin slot will engage and cause said pivotal latch to pivotally move against the bias of said coil spring toward said first coin slot.

4. The actuation mechanism of claim 1 wherein said carrier wheel having said coin recesses of predetermined widths for receiving first and second coins is replaceable with another carrier wheel identical thereto except for a change in the width of one or both of said coin recesses in order to accommodate a different number of coins in one or both of said coin recesses.

5. The actuation mechanism of claim 1 further comprising:

a shaft extending through said front cover plate, carrier wheel and rear retainer plate and having a forward end disposed at an exterior side of said front cover plate and a rearward end disposed at an exterior side of said rear retainer plate; and a handle disposed adjacent to said exterior side of said front cover plate and fixedly attached on said forward end of said shaft such that said handle may be turned by a user to rotate said shaft and said carrier wheel therewith away from said initial home position through said complete dispensing cycle.

6. The actuation mechanism of claim 5 further comprising:

a ratchet device including a ratchet wheel fixedly mounted to said rearward end of said shaft and a spring-loaded pawl pivotally mounted to said rear retainer plate adjacent to said ratchet wheel so as to engage in succession notches defined about said ratchet wheel such that said handle, shaft, ratchet wheel and carrier wheel can only be rotated in one direction once said shaft has rotated sufficiently to bring said pawl into engagement with a first of said notches on said ratchet wheel which then prevents reverse rotation of said handle, shaft, ratchet wheel and carrier wheel.

7. The actuation mechanism of claim 1 wherein said means for engaging said carrier wheel includes first and second detents movably mounted to said rear retainer plate and adapted to engage into said first and second coin recesses, said detents also adapted to ride over the first and second coins when deposited in said first and second coin recesses and thus not engage within said first and coin recesses of said carrier wheel when the first and second coins are deposited therein.

* * * * *